United States Patent [19]

McPherson

[11] 4,112,623

[45] Sep. 12, 1978

[54] MEETING RAIL FOR SLIDING WINDOWS

[76] Inventor: Neil Soden McPherson, 1162 W. 26 Ave., Vancouver, B.C., Canada, V6H 2A7

[21] Appl. No.: 832,158

[22] Filed: Sep. 12, 1977

[51] Int. Cl.[2] ..... E06B 7/22

[52] U.S. Cl. ..... 49/488; 49/406; 49/495

[58] Field of Search ..... 49/484, 486, 483, 495, 49/406, 485, 488

[56] References Cited

U.S. PATENT DOCUMENTS

| | | | |
|---|---|---|---|
| 2,739,358 | 3/1956 | Kunkel | 49/495 X |
| 2,798,578 | 7/1957 | Toth | 49/485 X |
| 3,229,332 | 1/1966 | Koller | 49/483 X |
| 3,396,491 | 8/1968 | Giesbrecht | 49/485 X |
| 3,518,792 | 7/1970 | Williamson et al. | 49/495 X |

*Primary Examiner*—Philip C. Kannan

*Attorney, Agent, or Firm*—Carver and Company

[57] ABSTRACT

A meeting rail for application to overlapping marginal edge portions of sliding window panes when the panes are closed having a strip of semi-rigid thermoplastic material with longitudinally extending spaced apart ribs of flexible thermoplastic material being fused to the semi-rigid thermoplastic material and extending from one side of the strip and a pressure sensitive adhesive on the opposite side of the strip to enable the rails to be secured in pairs to said edge portions, height and spacing of the ribs being such that the ribs of opposing rails are disposed in interdigital relationship when the panes are closed.

1 Claim, 3 Drawing Figures

MEETING RAIL FOR SLIDING WINDOWS

BACKGROUND OF THE INVENTION

1. Field of the Invention

This invention relates to meeting rails for sliding windows for effecting weather seal engagement.

2. Prior Art

In sliding window assemblies it is common to have one pane fixed in a frame and another plane slideably mounted in the frame in parallelism but slightly spaced from the first mentioned pane, widths of the panes being such that with the sliding pane in a closed position the panes have meeting overlapping edge portions commonly termed "meeting rail areas". It is usual practice to provide a meeting rail which is secured to the overlapping edge portion of each pane which have a slideable sealing contact with each other.

Meeting rails of prior art have, in the main, taken the form of U-shaped aluminum or plastic extrusions which fit over the marginal edge portions of the window panes and which either have a frictional grip thereon or are secured thereon by an adhesive. This type of meeting rail is relatively costly, and is difficult to apply, usually beyond the capabilities of the average homeowner.

The meeting rails of prior art are also deficient in that they do not provide much latitude or margin of error in window construction to always effect a seal.

SUMMARY OF THE INVENTION

The present invention provides a meeting rail weathersealing assembly which is relatively inexpensive and which can easily be applied by the average homeowner and which accommodates extensive variation in spacing between the windows and yet provides a seal.

The meeting rail of the present invention in one embodiment has at least one strip of semi-rigid plastic material from the side surface of which project a plurality of longitudinally extending parallel ribs formed of a flexible thermoplastic material fused to said semi-rigid strip and a pressure adhesive on the opposite side of the semi-rigid strip for enabling the strip to be adhered to the side surfaces of the marginal edge portions of said sliding windows in a position wherein the ribs of the opposing strips extend in interdigital relationship when the window is closed.

A detailed description following, related to the drawings, gives exemplification of apparatus according to the invention which, however, is capable of expression in means other than those particularly described and illustrated.

DETAILED DESCRIPTION

Figure 1:
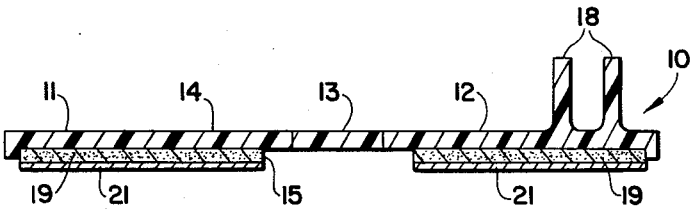
FIG. 1 is a transverse sectional view of one embodiment of the invention.
Figure 2:
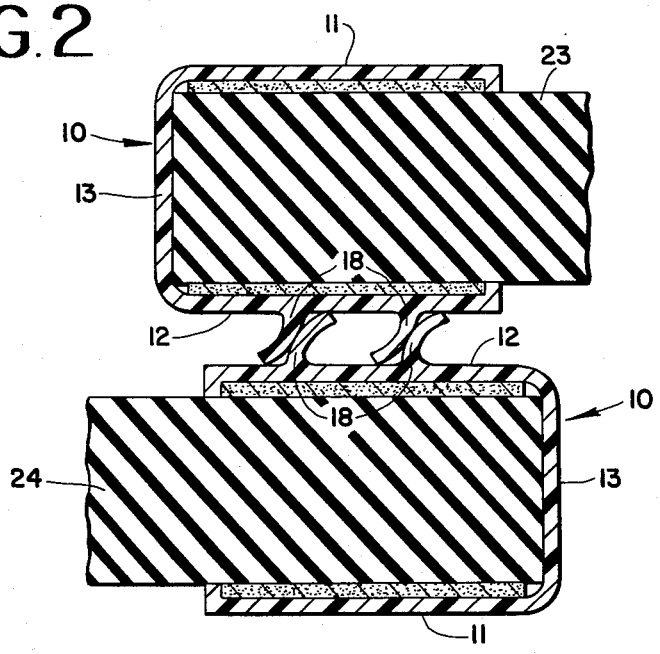
FIG. 2 is a transverse sectional view of the embodiment as disclosed in FIG. 1 applied to opposing overlapping marginal edges of a pair of sliding window panes.

Referring to the drawings, in particular to FIGS. 1 and 2 thereof, one embodiment 10 of a meeting rail in accordance with the invention is shown. The meeting rail 10 has a pair of flat strips 11 and 12 of semi-rigid thermoplastic material, for example, a polyethylene or a vinyl, between which a flat strip 13 of flexible thermoplastic of the same type and thickness extends. Adjacent edges of the strips 11, 12 and 13 are heat welded so that the strip is of substantially integral construction having unbroken outer and inner surfaces 14 and 15, respectively. Heat welding of thermoplastic material of varying consistency of this type is well known and requires no further description.

The strip 12 also has a plurality, ribs 18—18 (only two being shown) formed of a flexible thermoplastic material preferably of the same type of thermoplastic material as the outer strip 13, extending longitudinally thereof from the outer surface 14. These ribs are thin, being approximately 1/16th of an inch in thickness for standard windows and approximately 1/4th of an inch in height and are spaced approximately 3/16th inches apart. The strips 11, 12 and 13 together with the ribs can be extruded sections and contain suitable plasticizers which can be adjusted to provide required characteristics of rigidity and flexibility. The strips 11 and 12 must have sufficient rigidity so that they maintain a straight line configuration without wrinkling and the center strips 13 must have sufficient flexibility to enable the embodiment 10 to be bent to a U-shaped configuration.

The inner surfaces of the strips 11 and 12 are coated with a pressure sensitive adhesive 19—19, the adhesive strips being covered by removeable cover strips 21—21 which can be stripped therefrom to expose the adhesive when the meeting rail is to be used. Width of the center strip 13 is dependent upon and should be the same width as the thickness of the window glass to which the meeting rail is to be applied. Width of the strips 11 and 12 is not critical and depends largely on the number of ribs with which each meeting rail is to be provided. Thickness of the strips 11, 12 and 13 is not critical but can preferably be 20 to 40 mls in thickness such that the strips can be cut transversely with scissors or a knife.

As shown in FIG. 2, the strips are applied to overlapping marginal edge portions 23 and 24 of a pair of window panes located in a frame, not shown, pane 23 being fixed and pane 24 being slideable between open and closed positions, closed position being shown as in FIG. 2. The protective cover strips are stripped from the meeting rails and the meeting rails applied on said marginal edge portions with the center strips of each of the strips over the outer edges of the windows and with the strips 11 and 12 secured to opposite side surfaces of said marginal edge portions with the ribs of each strips confronting each other. The stiffness of the outer strips 11 and 12 enable each meeting rail to be applied to it's associated pane with the strips extending absolutely parallel to the edge of the window so that the ribs of each pane extend in fixed parallelism.

The meeting rail, as pointed out hereinbefore, is related to the pane thickness so that when the pane is arranged in a closed position as shown in FIG. 2 with the marginal edges in overlapping configuration the ribs of the meeting rails will assume an interdigital relationship so that at least one of the ribs of one of the meeting rails will be located between at least a pair of ribs of the other meeting rails.

Construction of the meeting rails as above described accommodates a wide variation of pane spacing and yet provides sealing between the two panes. With the panes spaced apart a little less than the height of the ribs as shown in FIG. 2, the ribs of each meeting rail makes sealing contact with the semi-rigid strip of the other meeting rail. However, if the panes are spaced apart a distance greater than the height of the ribs, the ribs being in interdigital relationship, can make contact with each other and thus effect a seal. Due to the flexibility of the ribs there is little, or no hindrance to movement of the sliding pane.

The meeting rail can also be applied to a pane edge with some degree of accuracy as the semi-rigid strips, will not wrinkle or bend and can be laid in substantially exact parallelism with the window edge, the flexible strip giving some protection to the edge itself.

Figure 3:
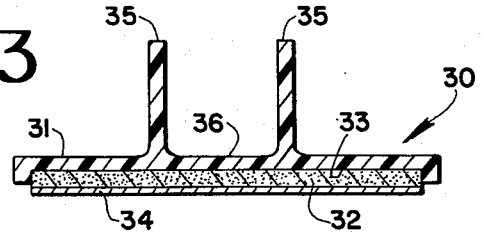
FIG. 3 is a transverse sectional view of another embodiment of the invention.

FIG. 3 shows another embodiment 30 of a meeting rail. Embodiment 30 has a single strip of semi-rigid thermoplastic material 31 having an adhesive backing 32 on one side 33 thereof which is protected by a removeable strip 34 and longitudinally extending and spaced apart ribs 35 formed of a flexible thermoplastic material extending from the opposite side 36. The meeting rail 30 is applied only to one side surface of the marginal edge portions of the panes but operates exactly in the same manner as described with reference to meeting rail 10.

I claim:

1. A meeting rail assembly for application to over lapping marginal edge portions of closable sliding win dow panes comprising:

(a) a pair of meeting rails, one for each window, (b) each meeting rail comprising:

(i) a pair of parallel planar strips of semi-rigid thermoplastic material having inner and outer side surfaces, (ii) a connecting strip of flexible thermoplastic material extending parallel to and positioned between and fused at its edges to adjacent edges of the semi-rigid strips, (iii) a plurality of parallel, longitudinally extending spaced-apart ribs disposed on the outer side surface of one of the semi-rigid strips of each rail, said ribs being of a flexible thermoplastic material and being fused to said one semi-rigid strip, (iv) a pressure sensitive adhesive on the inner surfaces of the semi-rigid strips for enabling the meeting rails to be applied and secured to said marginal edge portions of the panes in a position in which the ribs of opposing rails extend in inter-digital relationship when the panes are closed.

* * * * *